US006374737B1

(12) United States Patent
Bennett et al.

(10) Patent No.: US 6,374,737 B1
(45) Date of Patent: Apr. 23, 2002

(54) PRINTING PLATE MATERIAL WITH ELECTROCOATED LAYER

(75) Inventors: David S. Bennett, Davenport; Sallie L. Blake, Long Grove, both of IA (US); Robert E. Bombalski, New Kensington, PA (US); Kenneth A. Bowman, Apollo, PA (US); Joseph D. Guthrie, Murrysville, PA (US); Thomas L. Levendusky, Greensburg, PA (US); Daniel L. Serafin, Wexford, PA (US); Jean Ann Skiles, Gibsonia, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 09/644,010

(22) Filed: Aug. 22, 2000

Related U.S. Application Data

(63) Continuation-in-part of application No. 09/519,018, filed on Mar. 3, 2000.

(51) Int. Cl.[7] ..... B41C 1/10; B41N 1/08

(52) U.S. Cl. ..... 101/457; 205/153; 205/317

(58) Field of Search ..... 101/454, 457, 101/458, 459, 463.1, 465–467; 204/492–498; 205/139, 153, 213, 214, 317

(56) References Cited

U.S. PATENT DOCUMENTS

| | | | | | |
|---|---|---|---|---|---|
| 3,945,899 | A | * | 3/1976 | Nikaido et al. | 204/495 |
| 3,962,060 | A | | 6/1976 | Brasko et al. | 204/181 |
| 4,263,194 | A | * | 4/1981 | Turpin | 204/493 |
| 4,405,427 | A | * | 9/1983 | Byrd | 205/317 |
| 4,492,616 | A | * | 1/1985 | Pliefke et al. | 101/459 |
| 4,911,075 | A | | 3/1990 | Lewis et al. | 101/453 |
| 5,153,095 | A | | 10/1992 | Kawamura et al. | 430/175 |
| 5,249,525 | A | | 10/1993 | Lewis et al. | 101/453 |
| 5,296,127 | A | * | 3/1994 | Saunders | 205/317 |
| 5,339,737 | A | * | 8/1994 | Lewis et al. | 101/454 |
| 5,353,705 | A | | 10/1994 | Lewis et al. | 101/453 |
| 5,379,698 | A | | 1/1995 | Nowak et al. | 101/454 |
| RE35,512 | E | | 5/1997 | Nowak et al. | 101/454 |
| 5,691,114 | A | * | 11/1997 | Burberry et al. | 101/463.1 |
| 5,711,991 | A | * | 1/1998 | Robinson et al. | 427/202 |
| 5,713,387 | A | | 2/1998 | Gelbart | 101/467 |
| 5,795,647 | A | * | 8/1998 | Robinson et al. | 428/329 |
| 5,934,197 | A | * | 8/1999 | Goulet | 101/467 |
| 5,965,326 | A | | 10/1999 | Ellis | 430/309 |
| 5,988,066 | A | | 11/1999 | Robinson et al. | 101/457 |
| 6,145,565 | A | * | 11/2000 | Fromson et al. | 101/459 |
| 6,232,037 | B1 | * | 5/2001 | Uesugi et al. | 101/459 |

* cited by examiner

*Primary Examiner*—Stephen R. Funk
(74) *Attorney, Agent, or Firm*—Julie W. Medar; Glenn E. Klepac

(57) ABSTRACT

A process for making printing plate material suitable for imaging by laser radiation. A metal substrate is electrocoated in a bath containing a polymeric resin and laser-sensitive particles, thereby depositing a laser ablatable layer on a principal surface of the metal substrate. In one embodiment, the laser-ablatable layer is treated with a corona discharge for a time sufficient to render the layer non-ink wettable. In other preferred embodiments, the laser-ablatable layer is overcoated with an overlayer such as a non-ink wettable silicone layer or a water-wettable layer comprising an organophosphorus polymer, preferably a copolymer of acrylic acid and vinylphosphonic acid.

18 Claims, 1 Drawing Sheet

PRINTING PLATE MATERIAL WITH ELECTROCOATED LAYER

RELATED APPLICATION

This application is a continuation-in-part application of U.S. Ser. No. 09/519,018 filed Mar. 3, 2000 entitled "Electrocoating Process for Making Lithographic Sheet Material."

FIELD OF THE INVENTION

The present invention relates to printing plate materials suitable for imaging by digitally controlled laser radiation. More particularly, the invention relates to printing plate materials having an electrocoated layer thereon.

BACKGROUND OF THE INVENTION

Printing plates suitable for imaging by digitally controlled laser radiation are produced commercially. However, the existing processes for making such plates are expensive and wasteful. Accordingly, there still remains a need for a more efficient and economical process of making such plates.

Laser radiation suitable for imaging printing plates preferably has a wavelength in the near-infrared region, between about 400 and 1500 nm. Solid state laser sources (commonly termed "semiconductor lasers") are economical and convenient sources that may be used with a variety of imaging devices. Other laser sources such as $CO_2$ lasers and lasers emitting light in the visible wavelengths are also useful.

Laser output can be provided directly to the plate surface via lenses or other beam-guiding components, or transmitted to the surface of a blank printing plate from a remotely sited laser through a fiber-optic cable. A controller and associated positioning hardware maintains the beam output at a precise orientation with respect to the plate surface, scans the output over the surface, and activates the laser at positions adjacent selected points or areas of the plate. The controller responds to incoming image signals corresponding to the original figure or document being copied onto the plate to produce a precise negative or positive image of that original. The image signals are stored as a bitmap data file on the computer. Such files may be generated by a raster image processor (RIP) or other suitable means. For example, a RIP can accept data in page-description language, which defines all of the features required to be transferred onto a printing plate, or as a combination of page-description language and one or more image data files. The bitmaps are constructed to define the hue of the color as well as screen frequencies and angles.

The imaging apparatus can operate on its own, functioning solely as a platemaker, or can be incorporated directly into a lithographic printing press. In the latter case, printing may commence immediately after application of the image to a blank plate, thereby reducing press set-up time considerably. The imaging apparatus can be configured as a flatbed recorder or as a drum recorder, with the lithographic plate blank mounted to the interior or exterior cylindrical surface of the drum. Obviously, the exterior drum design is more appropriate to use in situ, on a lithographic press, in which case the print cylinder itself constitutes the drum component of the recorder or plotter.

In the drum configuration, the requisite relative motion between the laser beam and the plate is achieved by rotating the drum (and the plate mounted thereon) about its axis and moving the beam parallel to the rotation axis, thereby scanning the plate. Circumferentially so the image "grows" in the axial direction. Alternatively, the beam can move parallel to the drum axis and, after each pass across the plate, increment angularly so that the image on the plate "grows" circumferentially. In both cases, after a complete scan by the beam; an image corresponding (positively or negatively) to the original document or picture will have been applied to the surface of the plate.

In the flatbed configuration, the beam is drawn across either axis of the plate, and is indexed along the other axis after each pass. Of course, the requisite relative motion between the beam and the plate may be produced by movement of the plate rather than (or in addition to) movement of the beam.

Regardless of the manner in which the beam is scanned, it is generally preferable (for reasons of speed) to employ a plurality of lasers and guide their outputs to a single writing array. The writing array is then indexed, after completion of each pass across or along the plate, a distance determined by the number of beams emanating from the array, and by the desired resolutions (i.e., the number of image points per unit length.)

Some prior art patents disclosing printing plates suitable for imaging by laser ablation are Lewis et al U.S. Pat. Nos. 5,339,737 and 5,353,705 and Nowak et al. U.S. Pat. No. Re. 35,512. The disclosures of those patents are incorporated herein, to the extent consistent with our invention.

Although these prior art printing plates perform adequately, they are expensive to produce because the absorbing layer is vapor deposited onto the oleophilic polyester layer. Adhesive bonding of the polyester layer to a metal substrate also adds to the cost.

A principal objective of the present invention is to provide a printing plate material wherein a laser-ablatable layer is deposited on a substrate by electrocoating. The electrocoating process of our invention coats metal substrates at greater speed and with improved quality compared to prior art processes such as laminating, adhesive bonding, extrusion coating, and roll coating.

A related objective of our invention is to provide a process suitable for making both positive and negative lithographic plates.

Additional objectives and advantages of our invention will become apparent to persons skilled in the art from the following description of some preferred embodiments.

SUMMARY OF THE INVENTION

In accordance with the present invention, there is provided an improved process for making printing plate material suitable for imaging by laser radiation. The process of our invention is useful for making negative printing plates and for making positive printing plates.

The process of the invention makes printing plate material by coating a substrate with one or more polymeric layers. The substrate is a metal, preferably an aluminum alloy or steel. Some suitable aluminum alloys include alloys of the AA 1000, 3000, and 5000 series. Suitable steel substrates include mild steel sheet and stainless steel sheet.

An aluminum alloy substrate should have a thickness of about 1–30 mils, preferably, about 5–20 mils, and more preferably about 8–20 mils. An unanodized aluminum alloy substrate having a thickness of about 8.8 mils is utilized in a particularly preferred embodiment.

The substrate may be mill finished or, more preferably, may be further finished via roll texturing, chemical texturing, mechanical texturing, electrochemical texturing or combinations thereof. Roll texturing may be accomplished with a roll having an outer surface roughened via electron discharge texturing (EDT), laser texturing, electron beam texturing, mechanical texturing, chemical texturing, electrochemical texturing or combinations thereof. Preferred mechanical texturing technique include shot peening and brush graining. A preferred technique for roll texturing is EDT. In EDT, a plurality of arc generating electrodes are spaced from the outer surface of the roll and pulses of electron arcs are discharged against the roll outer surface. The arcs provide a generally uniform roll surface of peaks and valleys of desired dimensions. The electrodes rotate and traverse across the roll outer surface. The dimensions are controlled at least in part by the voltage level and the current level of the arcs, the length of the arc pulses, the length of time between arc pulses, and the electrode rotational speed and traverse rate. Electron discharge texturing is disclosed in U.S. Pat. Nos. 3,619,881 and 4,789,447, both being incorporated herein by reference.

When textured rolls, for example rolls subjected to EDT, are used to roll the substrate, the surface area of the substrate is increased (extended) in a non-directional manner. A preferred level of surface area extension of a nominally flat aluminum sheet (mill finished) is preferably about 0.5 to 10%. The surface of roughness (Ra) of aluminum sheet rolled with EDT treated rolls is preferably about 5 to less than 15 microinches, more preferably about 6 to about 9 microinches.

The resulting textured surface provides a more diffuse surface than a mill finished surface with concomitant higher uniformity in the surface. During laser ablation, non-uniform surface defects have been associated with laser back reflections. The textured surface of the product of the present invention minimizes laser back reflections and improves the uniformity and efficiency of the laser ablation process.

A principal surface of the metal surface is cleaned to remove surface contaminants such as lubricant residues. Some suitable chemical surface cleaners include alkaline and acid aqueous solutions. Plasma radiation and laser radiation may also be utilized. After the principal surface is cleaned, it is coated with a laser-ablatable layer by electrocoating. By the term laser-ablatable it is meant that the material or layer is subject to absorption of infrared laser light causing ablation thereof.

The electrocoating process of our invention may be either anodic electrocoating or cathodic electrocoating. The anodic process involves immersing a continuous coil of aluminum alloy sheet into an aqueous electrocoating bath. The sheet is grounded and an electric current is passed between a cathode in the bath and the sheet which functions as the anode. The bath contains an emulsified polymeric resin and may also include laser-sensitive particles combined with an acrylic resin. Total solids content of the bath is generally about 5–20 wt. %. Electric current passing through the bath electrolyzes water, generates hydronium ions at the sheet surface. The hydronium ions react with amine groups on the polymeric resin, liberating the acrylic polymer that precipitates on the sheet surface. Similarly, amine groups on molecules of acrylic resin combined with the laser sensitive particles are also neutralized, thereby precipitating the particles along with the polymeric resin as a laser-ablatable layer on the sheet surface. When the metal substrate is formed from an aluminum alloy, the electric current also generates a thin layer of anodic oxide between the aluminum substrate and the laser-ablatable layer. Prior to electrocoating the aluminum substrate, the substrate typically bears on its exposed surfaces (including the principal surface) an inherent non-uniform hydrated aluminum oxide layer. This inherent aluminum oxide layer generally contains flaws that may have been caused by thermomechanical processing of the substrate or contamination introduced by such thermomechanical processing (e.g. lubricants or coolants) or via other handling procedures. Upon application of the electric current, the inherent oxide layer is removed and a nonporous anodic oxide layer forms in its place between the substrate and the polymer layer. The nonporous anodic oxide layer is a continuous layer without the flaws typical of the inherent oxide layer of the aluminum substrate and is typically about 50 to about 100 Angstroms thick.

In the cathodic electrocoating process of the present invention, the substrate functions as the cathode. The cathode (substrate) is bathed with an alkaline resin solubilized in an acidic solution. Upon application of an electric current from an anode (the tank containing the bath or a separate anode), the resin is dehydrated and deposits on the substrate. In order to create a uniform surface on the sheet rendering the substrate receptive to the electrocoating (comparable to the nonporous anodic oxide layer of the anodic electrocoated sheet), the substrate may be chemically pretreated with a conversion coating or electrochemically pretreated in an anodizing process to produce an anodic oxide layer thereon. The conversion coating may include salts of chromium, phosphate, zirconium, titanium and molybdenum. A chrome-phosphate conversion coating is particularly preferred. Other suitable conversion coatings may contain silicates or other metals such as vanadium, niobium, tantalum, and hafnium.

The laser-sensitive particles preferably are particles of a metal, mineral or carbon having an average particle size of about 7 microns or less. The metal particles may be copper, cobalt, nickel, lead, cadmium, titanium, iron, bismuth, tungsten, tantalum silicon, chromium aluminum or zinc, preferably iron, aluminum, nickel, or zinc. The mineral particles may be oxides, borides, carbides, sulfides, halides or nitrides of the metals identified above or clay. Clay includes aluminum silicates and hydrated silicates such as feldspar and kaolinate. Carbon may be used in the form of carbon black, graphite, lamp black or other commercially available carbonaceous particles. Combinations of particles having different compositions are within the scope of our invention. Iron oxide particles having an average size of less than 1 micron are particularly preferred. When the laser-sensitive particles are included in the coating bath, the amount of the laser-sensitive particles in the coating bath may be as low as 1 ppm and as high as 50 wt. %, is preferably about 1–10 wt. % and is about 5 wt. % in a particularly preferred embodiment.

The emulsified polymeric resin in the bath preferably comprises a polymer of acrylic acid or methacrylic acid, or their analogs and esters, alone or in mixtures and copolymers with an epoxy resin. Carboxylic acid groups on the acrylic polymer are neutralized by a base, preferably an organic amine.

The electrocoating process is self-limiting. As the coating thickness increases, the electrical resistance of the electrocoated layer also rises until current can no longer flow thereby limiting the amount of coating deposited. Coating thickness is also limited by the speed at which the metal sheet passes through the bath and by the bath composition. The coating may have a thickness of about 0.01–1 mil. A coating having a thickness of about 0.05–0.3 mil is particularly preferred. The electrocoated layer is more uniform than layers deposited by other means such as roll coating and provides a consistent thickness of the layer on each coated substrate and from batch to batch. The edge-center-edge differences associated with roll coating are avoided. The laser-sensitive particles make up about 5 wt. % of the coating in a particularly preferred embodiment.

The electrocoated laser-ablatable layer of polymeric resin and laser-sensitive particles is cured by heating to a temperature of about 100–300° C. for a few seconds or less.

In a first embodiment of the printing plate of the present invention, the electrocoated sheet is oleophilic (i.e. ink wettable) and may be used directly as a printing plate for applications in which an ink-wettable top surface is desired. The electrocoated polymer layer may be laser-ablated to expose the principal surface of the substrate except in the location of the desired image area. The metal substrate may act hydrophilic (i.e. water wettable) or oleophilic depending on the water affinity and ink affinity properties of the layers thereon. In a case where the electrocoated polymer layer is oleophilic, the metal substrate will act hydrophilic. When a conventional printing fountain solution containing ink and water is used with the laser-ablated sheet, the ink adheres to the polymer layer in the image area while water adheres to the metal substrate in the background (non-image) area. Alternatively, the image area may be laser-ablated to render the image area hydrophilic and retain the background area as oleophilic so that water adheres to the image area and ink adheres to the background.

In this embodiment, it is also possible to laser ablate only a portion of the electrocoated polymer layer so as to not expose the underlying substrate. The laser ablation process may alter the ink affinity of the polymer such that the partially ablated areas of the printing plate become hydrophilic while the non-ablated areas remain oleophilic.

In a second embodiment of the inventive printing plate, an upper portion of the laser-ablatable layer of the electrocoated polymer is made hydrophilic by treating the surface of the electrocoated polymer layer. In this manner, an upper portion of the layer of electrocoated polymer is hydrophilic while a lower portion remains oleophilic. Treatment of the upper portion of the laser-ablatable layer of the electrocoated polymer may be accomplished via corona discharge treatment or by including inorganic particles therein to render the electrocoated polymer hydrophilic.

As used herein, the term "corona discharge" refers to a treatment in which air or other gas is ionized in close proximity to the coating surface. Ionization of the gas is initiated by passing a high voltage current through an electrode in close proximity to the surface, thereby causing oxidation and other changes on the coating surface. Corona discharge is typically operated with a power source providing about 6–20 KV at a frequency of about 2–50 KHz, preferably about 2–30 KHz. The upper portion of the corona discharged treated electrocoated polymer layer is hydrophilic while the underlying bulk of the polymer layer remains oleophilic. During laser ablation of the polymer layer, the ablation process may be controlled so that the upper portion of the polymer layer is ablated but the underlying metal substrate is not exposed. In this manner, portions of the polymer layer are hydrophilic (where not ablated) and other portions are oleophilic (where the corona discharge treated polymer has been ablated.)

When the laser-ablatable electrocoated polymer includes inorganic particles, the particles may include metal oxides, preferably aluminum oxides. The inorganic particles may be co-deposited with the electrocoated polymer at approximately 5 wt. % or the inorganic particles may be applied to the surface of the electrocoated polymer layer prior to curing thereof.

In a third embodiment of the invention, the printing plate further includes a hydrophilic second layer or overlayer on top of the electrocoated polymer layer. More than one hydrophilic overlayer may be included in the sheet, however, the present invention is described hereinafter with regard to a single hydrophilic overlayer. This is not meant to be limiting in that the present invention includes the use of one or more hydrophilic overlayers. The hydrophilic overlayer may have the same or different affinity for printing fluid as does the electrocoated polymer layer or the underlying substrate or both. At least one of the electrocoated polymer layer and the hydrophilic overlayer includes laser-sensitive particles to render the layer containing those particles (and any overlying layer) ablatable by a laser.

The hydrophilic overlayer may include a) a hydrophilic polymer, b) a hydrophilic polymer composition containing dye or inorganic particles, c) a silicone polymer or copolymer composition containing inorganic particles in a concentration sufficient to make the silicone composition hydrophilic or d) a solvent borne composition containing dye or inorganic particles.

A preferred hydrophilic polymer is an organophosphorus, compound. As used herein, the term "organophosphorus compound" includes organophosphoric acids, organophosphonic acids, organophosphinic acids, as well as various salts esters, partial salts, and partial esters thereof. The organophosphorus compound may be copolymerized with acrylic acid or methacrylic acid. Copolymers of vinyl phosphonic acid are preferred, especially copolymers containing about 5–50 mole % vinyl phosphonic acid and about 50–95 mole % acrylic acid and having a molecular weight of about 20,000–100,000. Copolymers containing about 70 mole % acrylic acid groups and about 30% vinylphosphonic acid groups are particularly preferred. The hydrophilic polymer may be applied in batch processing of sheet or in coil processing by conventional coating processes including roll coating, powder coating, spray coating, vacuum coating, immersion coating or anodic electrodeposition. Preferably, the hydrophilic polymer is applied by roll coating, typically to a thickness of about 0.01–1.0 mil, preferably about 0.1–0.3 mil.

The dye preferably includes an azine compound or an azide compound or any other dye that absorbs light in the range of about 500 to about 1100 nanometers. A preferred dye is Nigrosine Base BA available from Bayer Corporation of Pittsburgh, Pa. The inorganic particles may be particles of a metal, mineral or carbon as described above, and preferably are oxides of transition metals. Particularly preferred inorganic particles include manganese oxide, magnesium oxide and iron oxide. The dye or inorganic particles may be solvated or suspended in an organic solvent such as methyl ethyl ketone or nigrosine. The solution is applied to the electrocoated polymer layer by roll coating or spray coating, and the solvent is removed leaving a hydrophilic overlayer of the dye or inorganic particles. When the overlayer includes a vinyl phosphonic acid copolymer and an azine dye, a preferred concentration of the dye is about 1–10 wt. %, preferably about 3–5 wt. % When the overlayer includes a vinyl phosphonic acid copolymer and manganese oxide, a preferred concentration of manganese oxide particles having an average particle size of about 0.6 micron is about 1–15 wt. %.

When the dye is applied as the overlayer alone or in combination with a hydrophilic polymer, the underlying electrocoated polymer may be uncured or cured. The electrocoated polymer may be cured before the overlayer is applied or after the overlayer is applied.

The overlayer may include a silicone polymer or copolymer composition containing inorganic particles in a concentration sufficient to make the silicone composition hydrophilic. Silicone polymers or copolymers are typically hydrophobic and oleophobic. However, when inorganic particles are included in a composition of a silicone polymer or copolymer at a sufficient concentration, the composition is hydrophilic and may be used as the hydrophilic overlayer. Suitable silicone compositions include fluorosilicone, dimethyl silicone, diphenyl silicone, and nitryl silicone. The silicone composition may include additional particles such as carbon black, graphite, silica, iron oxide, zinc oxide, zirconium silicate, metal powders, and clays at a concentration of about 0.5–38 wt. %.

When the overlayer contains laser-sensitive particles (e.g. dye or inorganic particles), the overlayer may be laser-ablated in an image area to expose the underlying oleophilic electrocoated polymer layer leaving a background area of the non-ablated hydrophilic overlayer. The underlying electrocoated polymer layer may include laser-sensitive particles and also be laser-ablatable. Following laser-ablation of at least the overlayer, ink will adhere to the image area while the background area will be covered with water or a fountain solution. Alternatively, the background area may be laser-ablated to render the background area oleophilic and retain the image area as hydrophilic so that ink adheres to the background area and water or fountain solution adheres to the image area.

When the overlayer does not include laser-sensitive particles, the underlying electrocoated polymer layer includes laser-sensitive particles to render the electrocoated polymer layer laser-ablatable. In this case, the electrocoated polymer layer is ablated during laser imaging such that the hydrophilic overlayer and at least a portion of the electrocoated polymer layer are removed creating a hydrophilic area of unremoved overlayer and an oleophilic area of unremoved electrocoated polymer. Alternatively, the electrocoated polymer layer may be fully ablated to expose the underlying substrate creating a hydrophilic area of unremoved overlayer and an oleophilic area of the exposed substrate.

In a fourth embodiment of the invention wherein a lithographic plate is desired for use with waterless printing solutions, the printing plate includes an overlayer formed from a silicone polymer or silicone copolymer, collectively referred to hereinafter as a silicone overlayer. The silicone overlayer is preferably applied by roll coating, typically to a thickness of about 0.01–1.0 mil, preferably about 0.1–0.3 mil. The silicone overlayer is both hydrophobic (repels water) and oleophobic (repels ink). In use, the silicone overlayer is laser-ablated in the image area or in the background to expose the underlying oleophilic electrocoated layer. Ink of a waterless printing solution will adhere to the exposed region of the electrocoated layer and will be repelled by the non-ablated region.

BRIEF DESCRIPTION OF THE DRAWINGS

A complete understanding of the invention will be obtained from the following description when taken in connection with the accompanying drawing figures wherein like reference characters identify like parts throughout.

DETAILED DESCRIPTION OF PREFERRED EMBODIMENTS

Figure 1:
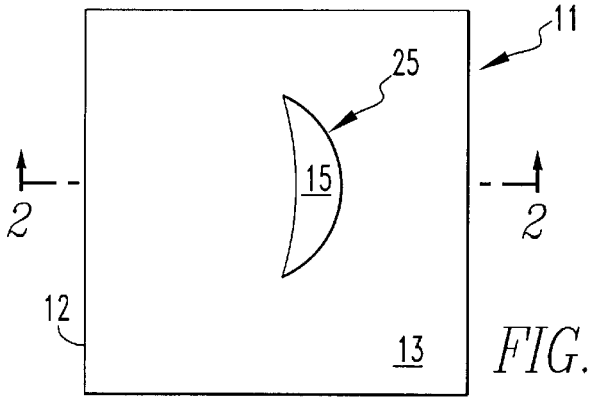
FIG. 1 is a schematic, top plan view of a first embodiment of the lithographic printing plate made in accordance with the present invention after exposure to the laser beams shown in FIG. 2.

For purposes of the description hereinafter, the terms "upper", "lower", "right", "left", "vertical", "horizontal", "top", "bottom" and derivatives thereof relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

Figure 2:
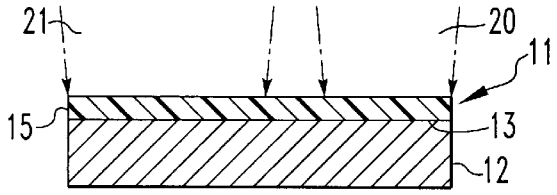
FIG. 2 is a cross-sectional view taken along the line 2—2 of FIG. 1.

In FIGS. 1 and 2 there is shown the first embodiment of printing plate 11 made in accordance with the present invention. The printing plate 11 includes an unanodized aluminum alloy substrate 12 having a principal surface 13 coated with a laser-ablatable layer 15. The substrate 12 has a thickness of about 8.8 mils. The laser-ablatable layer 15 has a thickness of about 0.1 mil (2.5 microns) and contains about 95 wt. % of a mixture of acrylic and epoxy polymers, together with about 5 wt. % iron oxide particles having an average particle size of less than about 1 micron. The layer 15 is applied to the sheet surface 13 by electrocoating.

Laser beams 20, 21 shown in FIG. 2 impinge upon the laser-ablatable layer 15 and removes the layer 15 in the area corresponding to the background of the image, thereby producing the image area 25 shown in FIG. 1. The image area 25 is wettable by oleophilic printing inks and the principal surface 13 of FIG. 1 is water-wettable (hydrophilic).

Figure 3:
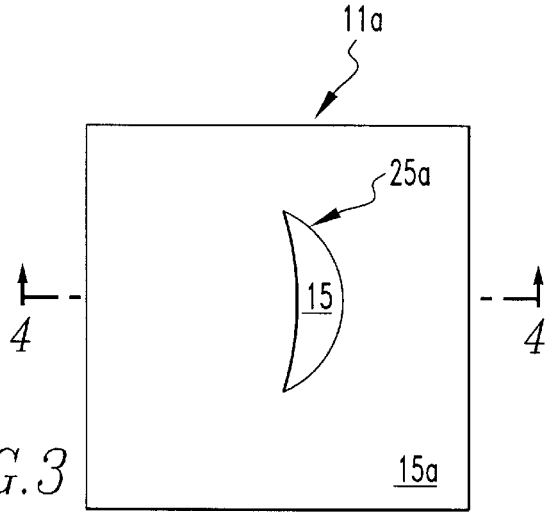
FIG. 3 is a schematic, top plan view of a second embodiment of the lithographic printing plate of the present invention after exposure to the laser beam shown in FIG. 4.
Figure 4:
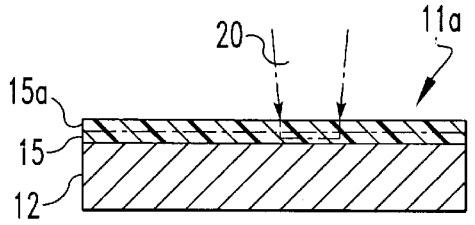
FIG. 4 is a cross-sectional view taken along the line 4—4 of FIG. 3.

FIGS. 3 and 4 show printing plate 11*a* of the second embodiment of the present invention. The sheet 11*a* includes the layer 12, and an upper portion 15*a* of the layer 15 which is hydrophilic. When the upper portion 15*a* is ablated by the laser beam 20 as shown in FIG. 4, the underlying layer 15 is exposed creating an image area 25*a* (FIG. 3) which is oleophilic. During laser-ablation of the layer 15*a*, some of the layer 15 may be ablated as well or the ablation may be controlled to remove only the upper portion 15*a* and none of the layer 15.

Figure 5:
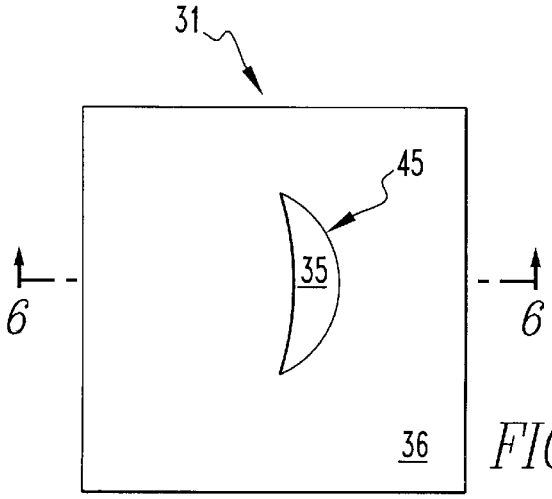
FIG. 5 is a schematic, top plan view of third and fourth embodiments of the lithographic printing plate of the present invention after exposure to the laser beam shown in FIG. 6.
Figure 6:
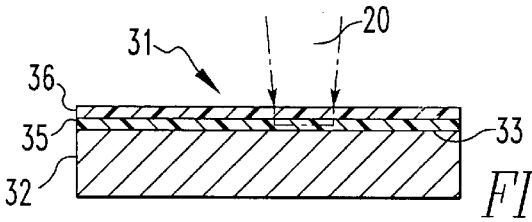
FIG. 6 is a cross-sectional view taken along the line 5—5 of FIG. 5.

FIGS. 5 and 6 show printing plate 31 of the third and fourth embodiments of the present invention. In the third embodiment, printing plate material 31 includes an unanodized aluminum alloy sheet substrate 32 having a principal surface 33 coated with a polymer layer 35. The substrate 32 has a thickness of about 8.8 mils. The polymer layer 35 has a thickness of about 0.1 mil (2.5 microns) and contains about 95 wt. % of a mixture of acrylic and epoxy polymers, together with about 5 wt. % iron oxide particles having an average particle size of less than about 1 micron. The polymer layer 35 is applied to the principal surface 33 by electrocoating. The polymer layer 35 is overcoated with an overlayer 36 having a thickness of about 0.01–0.3 mil. The overlayer 36 preferably comprises a hydrophilic water-wettable copolymer of acrylic acid and vinylphosphonic acid containing about 70 mole % acrylic acid groups and about 30 mole % vinylphosphonic acid groups. The copolymer has an average molecular weight of about 50,000 to 80,000. The overlayer 36 may contain additives of a dye or particles of carbon, metals or minerals or combinations thereof as described above.

As shown in FIG. 6, when laser beam 20 impinges upon the overlayer 36 and removes the overlayer 36 in the area corresponding to the image, an image area 45 is produced as shown in FIG. 5. The image area 45 is wettable by oleophilic printing inks and the background area of the overlayer 36 is hydrophilic. During laser-ablation of the overlayer 36, some of the layer 35 may be ablated as well or the ablation may be controlled to remove only the overlayer 36 and none of the layer 35.

Alternatively, the overlayer 36 may be formed from a silicone polymer or silicone copolymer and have a thickness of about 0.01–0.3 mil. The silicone overlayer is non-wettable by water (hydrophobic) and non-wettable by oleophilic printing inks (oleophobic). In this alternative embodiment, the sheet material 31 is useful for waterless printing processes. Upon laser-ablation of the silicone overlayer, the resulting image area 45 is oleophilic while the remaining background area is hydrophobic and oleophobic. This printing plate material is useful for printing with a waterless printing solution which will adhere to the image area 45. When a fountain solution is desired for printing, the background area can be modified to be hydrophilic by including additives of a dye or particles of carbon, metals, or minerals as disclosed above and combinations thereof in sufficient quantities. In that case, the additive-modified silicone overlayer 36 is hydrophilic and the image area 45 is oleophilic.

Although the invention has been described generally above, the particular examples give additional illustration of the product and process steps typical of the present invention.

EXAMPLE

Printing plate material was prepared according to the present invention by roll texturing a front side of a test sheet (Sheet A) of an Aluminum Association 3000 series alloy with an electron discharge textured (EDT) roll to create a diffuse surface. Sheet A was electrocoated with a layer 0.1 mils thick of about 95 wt. % of a mixture of acrylic and epoxy polymers, together with about 5 wt. % iron oxide particles having an average particle size of less than about 1 micron. A control sheet (Sheet B) of an Aluminum Association 3000 series alloy was mill finished (rolled with standard mill rolls and no EDT) and was electrocoated as for Sheet A. The front side and backside of Sheet A and the front side of Sheet B were tested at several positions for total reflectance and diffuse reflectance using a Milton Roy spectrophotometer at 550 nm and the specular reflection was calculated as the difference between the total reflectance and the diffuse reflectance as set forth in Table 1. Tests were run at two longitudinal positions along the sheet (Locations 1 and 2) with readings taken at the edges (locations a and b) and the center of the sheet (location c).

TABLE 1

| Sheet | Location | Total Reflectance | Diffuse Reflectance | Specular Reflectance |
|---|---|---|---|---|
| A-front | 1-a | 76.0 | 57.2 | 18.8 |
| A-front | 1-b | 75.8 | 56.1 | 19.7 |
| A-front | 1-c | 78.8 | 62.8 | 16.0 |
| A-front | 2-a | 75.7 | 58.0 | 17.7 |
| A-front | 2-b | 77.7 | 58.5 | 19.2 |
| A-front | 2-c | 78.1 | 62.1 | 16.0 |
| A-back | 1-a | 74.1 | 47.7 | 26.4 |
| A-back | 1-b | 74.7 | 45.4 | 29.3 |
| A-back | 1-c | 77.9 | 41.4 | 36.5 |
| A-back | 2-a | 73.6 | 47.5 | 26.1 |
| A-back | 2-b | 76.4 | 45.6 | 30.8 |
| A-back | 2-c | 78.4 | 40.2 | 38.2 |
| B | 1-a | 74.4 | 49.1 | 25.3 |
| B | 1-b | 74.3 | 47.7 | 26.6 |
| B | 1-c | 74.5 | 47.8 | 26.7 |
| B | 2-a | 74.3 | 48.3 | 26.0 |
| B | 2-b | 74.6 | 47.5 | 27.1 |
| B | 2-c | 74.3 | 48.9 | 25.4 |

The front side of Sheet A demonstrated significantly more diffuse reflection than the backside of Sheet A and than the control of Sheet B. The uniform roughness created by roll texturing of the front side of Sheet A minimizes specular reflectance and increases the uniformity of the sheet and the impact of an ablating laser thereon in the longitudinal and transverse directions.

Having described the presently preferred embodiments, it is to be understood that the invention may be otherwise embodied within the spirit and scope of the appended claims.

What is claimed is:

1. A printing plate comprising:

a metal substrate having a principal surface;

a polymer layer electrocoated onto said principal surface; and an overlayer coated onto said polymer layer, said overlayer comprising a hydrophilic material, wherein at least one of said polymer layer and said overlayer is laser-ablatable.

2. The printing plate of claim 1 wherein said overlayer is laser-ablatable and comprises an organophosphorous polymer and a plurality of laser-sensitive particles formed from a material selected from the group consisting of a dye, a metal, a mineral or carbon.

3. The printing plate of claim 1 wherein said electrocoated polymer layer comprises an oleophilic material.

4. The printing plate of claim 3 wherein said electrocoated polymer layer is laser-ablatable.

5. The printing plate of claim 3 wherein said electrocoated polymer layer is not laser-ablatable.

6. The printing plate of claim 1 wherein said principal surface has a roll textured surface.

7. The printing plate of claim 1 wherein said principal surface has a roll textured surface, said principal surface having an extended surface area of about 0.05–10%.

8. The printing plate of claim 7 wherein said principal surface has a surface roughness of about 5 to less than 15 microinches.

9. The printing plate of claim 7 wherein said principal surface has a surface roughness of about 6 to 9 microinches.

10. A process for making printing plate material suitable for imaging by laser radiation comprising a) providing a metal substrate having a principal surface;

b) immersing the metal substrate as a first electrode in a bath containing a polymeric resin and passing an electric current between the substrate and a second electrode of polarity opposite the first electrode, to deposit on at least the principal surface a polymer layer comprising the resin; and c) coating the polymer layer with a hydrophilic laser-ablatable overlayer containing a dye or inorganic particles.

11. The process of claim 10 further comprising a step of curing said polymer layer.

12. The process of claim 11 wherein said curing step is performed before step c).

13. The process of claim 11 wherein said curing step is performed after step c).

14. The process of claim 10 wherein said overlayer is coated onto the polymer layer via roll coating, spray coating, immersion coating, vacuum coating or electrodeposition.

15. The process of claim 10 further comprising a step of roll texturing the principal surface before performing step c).

16. The process of claim 15 wherein said roll texturing step comprises rolling the metal substrate with a roll having an electron discharge textured surface such that the principal surface has an extended surface area of about 0.05–10%.

17. The process of claim 16 wherein said the principal surface has a surface roughness of about 5 to less than 15 microinches.

18. The process of claim 16 wherein said the principal surface has a surface roughness of about 6 to 9 microinches.

* * * * *